United States Patent [19]

Kuc et al.

[11] 4,061,013

[45] Dec. 6, 1977

[54] METHOD OF FORMING SOCKET WRENCHES

[76] Inventors: John Kuc, 213 Avondale Road; Anthony Kuc, 601 Providence Road, both of Wallingford, Pa. 19086

[21] Appl. No.: 727,639

[22] Filed: Sept. 29, 1976

[51] Int. Cl.[2] ..... B21D 22/00

[52] U.S. Cl. ..... 72/354; 72/356; 72/358; 72/377

[58] Field of Search ..... 72/353, 354, 356, 358, 72/359, 377; 76/114

[56] References Cited

U.S. PATENT DOCUMENTS

| | | | |
|---|---|---|---|
| 2,417,569 | 3/1947 | Rice | 76/114 |
| 2,586,336 | 2/1952 | Huck | 72/354 X |
| 3,124,876 | 3/1964 | Putette | 72/354 X |

*Primary Examiner*—Leon Gilden
*Attorney, Agent, or Firm*—Morton J. Rosenberg

[57] ABSTRACT

An improved method of forming forged socket wrenches in a manner vitiating the need of further machining operation. Steel having a predetermined composition is received in coil form and treated with a lubricating coating. The coiled steel is then straightened and an initial billet of steel is cut to an appropriate size. The billet is then squared to establish opposing longitudinal surfaces in parallel relation with respect to each other and further to provide a working metal billet with a predetermined volume. The metal billet is then positionally located adjacent to a female die in order to provide a bearing surface to form a taper on at least a portion of the external surface of the metal billet. The socket wrench is then cold formed by the impacting of longitudinally opposing surfaces of the metal billet with a pair of metal dies to form the taper on the external surface of the billet and to provide a through opening of non-continuous contour in order to receive a driving tool on one end of the socket wrench and to receive a nut, bolt or other element of predetermined contour on an opposing end of the socket wrench.

10 Claims, 12 Drawing Figures

FIG. 9
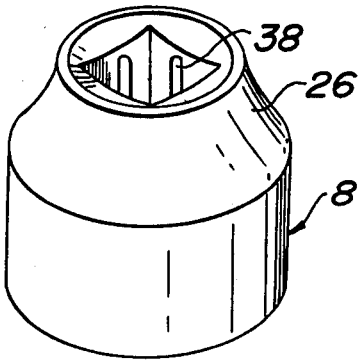
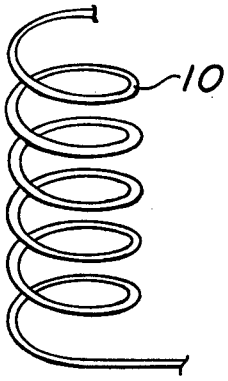
FIG. 1
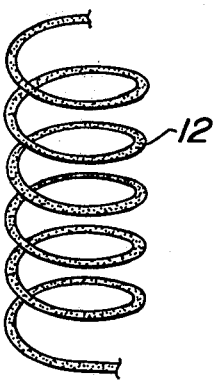
FIG. 2
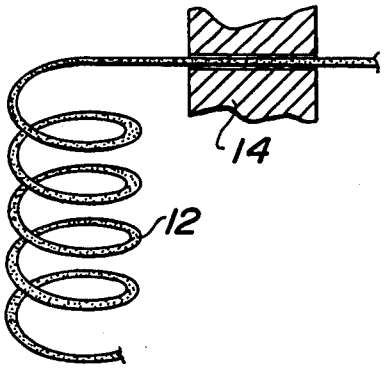
FIG. 3
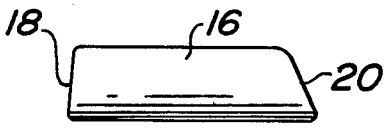
FIG. 4
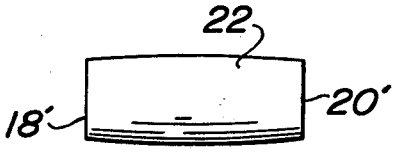
FIG. 5

FIG.6
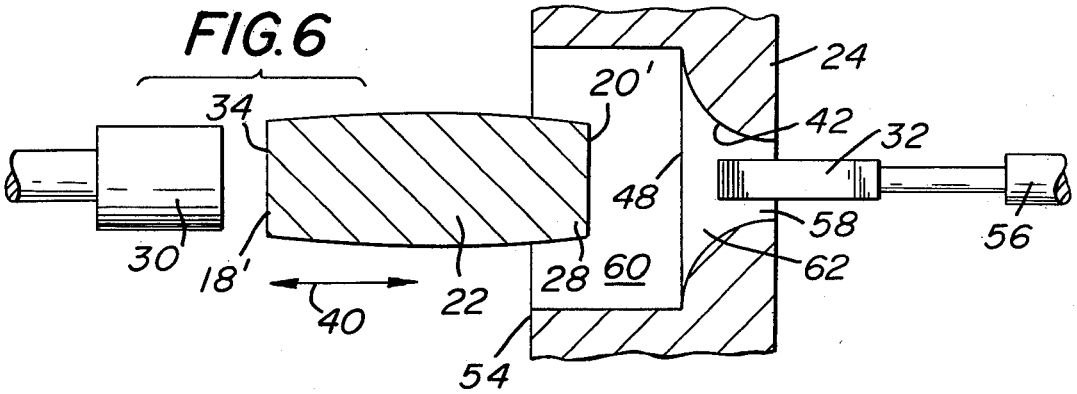
FIG.7
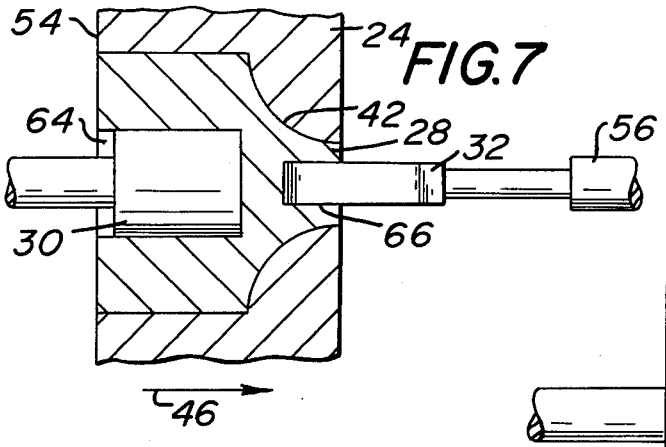
FIG.8
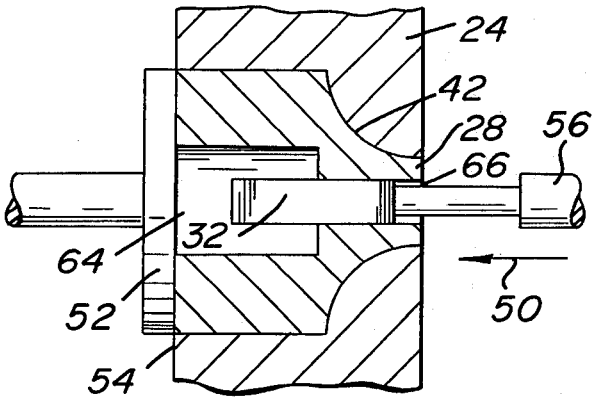
FIG.10
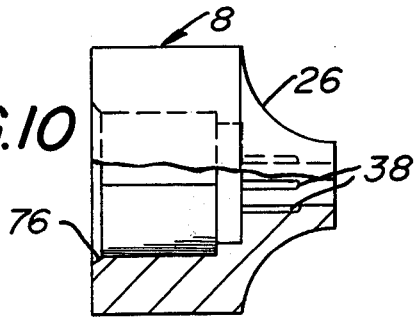
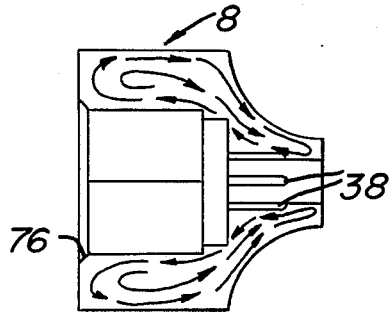
FIG.11
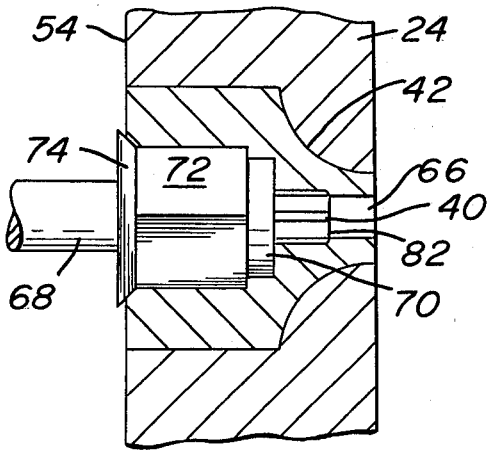
FIG.12

METHOD OF FORMING SOCKET WRENCHES

BACKGROUND OF THE INVENTION

Field of the Invention

This invention pertains to an improved method of forming metal products. In particular this invention relates to an improved method of cold forming and/or cold forging socket wrenches. Still further, this invention relates to a method of providing a completely cold formed or cold forged socket wrench which upon completion of the forging and/or forming process is completely finished. Still further this invention relates to an improved method of forming socket wrenches which results from a cold forming process where there are no cut or broken metal fibers to eliminate points of weaknesses in the overall strength of the socket wrench.

Prior Art

Methods of forming socket wrenches are known in the art. However in some prior cases, the socket wrenches are machined form bar stock. Such prior methods of manufacturing socket wrenches are generally completed in a standard screw machine. These methods include initial insertion of the bar stock into a lathe followed by through openings being drilled and the bar stock generally cut to predetermined longitudinal length. After these steps the stock is then inserted into a press where it is broached on opposing ends. This is followed by insertion into a lathe where the outside diameter is machined an a taper is provided as well as any chamfering, if such is required. Finally, in these prior methods the socket wrench is then placed in a milling machine where a ball detent is formed. Such prior processes include at least four steps and associated machine operations which greatly increase the cost of the manufactured socket wrenches.

In some prior methods, the socket wrenches are hot forged and machine completed. In such prior methods, predetermined volume slugs are cut off, followed by a hot forging process to form one opening in and end of the slug member. This initial forging is followed by a second hot forging process to form the opposing end and punch a contour to provide a non-continuous through opening in a longitudinal direction through the partially formed socket wrench. The partially formed socket wrench is then placed in a lathe where the outside diameter is machined and tapered as well as a chamfer being provided if such is necessary. In the final step of this process, ball detents are machined by one of a number of methods such as by insertion in a milling machine. As in the previous case, this hot forging and machine completing method provides for increased machine operation steps with a resulting high cost of labor to provide a relatively expensive finished socket wrench.

In some prior cases the socket wrench is cold forged and machine completed. In such methods, slugs of predetermined size are cut off and the opposing longitudinal ends are squared. This may be followed by annealing and a lubricant coating being applied to the external surfaces of the slugs. A non-continuous through opening is provided by a cold forging process which generally leaves a portion of the metal at the point of non-continuity of the through opening. The next step in such a process is to punch out the center slug or portion to provide a through opening. In general, the partially formed socket wrench is then placed in a lathe and the ends are faced off as well as a taper being provided. Finally the ball seat detents are formed through one of a number of machining operations such as an insertion into a milling machine. Such prior methods necessitate the use of a number of machining operations to provide the finished socket wrench which increases the labor costs as well as decreasing the production rate of the socket wrenches resulting in a relatively expensive socket wrench element.

SUMMARY OF THE INVENTION

A method of forming forged socket wrenches devoid of machining operations including the steps of initially establishing a solid metal billet having a predetermined volume which has an extended dimension in a longitudinal direction. The metal billet is then squared such that opposing longitudinal ends of the billet form a pair of opposing parallel planar faces. The squared metal billet is inserted within an internal cavity of a female die having a through opening and adapted to form a taper on at least a portion of an external surface of the metal billet. A first solid male die is located partially within the internal cavity and the first male die has a cross sectional area less than the cross sectional area of the female die through opening. A second end of the metal billet is longitudinally impacted with a second male die to form a first socket recess and the billet is extruded around the first male die to form a second socket recess.

An object of the present invention is to provide an improved method of forming socket wrenches utilizing a completely automatic cold forming process.

Another object of this invention is to provide a cold formed socket wrench being made on a continuous basis from coiled stock material.

A still further object of this invention is to provide a completely finished cold formed socket wrench without the need of any additional machining beyond the cold forming process.

A still further object of this invention is to provide a completed socket wrench being devoid of cut fibers after the cold forming process where such cut fibers would tend to weaken the structure.

A still further object of the invention is to eliminate any further machining operations in forming the retainer ball detent which is forged into the instant socket during the cold forming operation.

Another object of this invention is to eliminate the need of drilling or punching clearance holes as a secondary operation between a square drive end and a nut or bolt head end which has the effect of saving machine operations and material costs.

A still further object of this invention is to eliminate any upsetting of blanks as secondary operations prior to the cold forming operation.

A still further object of this invention is to provide an improved socket wrench having increased strength of the finished product due to continuous flow of the material during the cold forming process.

Another object of this invention is to eliminate a finished product having fins or flash which would have to be removed in the final product and thus eliminates any additional machining operations.

A further object of this invention is to provide chamfers and other rounded edges in a single forming operation in order to eliminate such secondary operation as additional machining criteria to decrease the cost of the final product.

BRIEF DESCRIPTION OF THE DRAWINGS:

FIG. 1 is a schematic diagram of steel received in coil form;

FIG. 2 is a schematic representation showing the steel in coil form being coated with a lubricant;

FIG. 3 is a schematic representation of the coiled steel being passed through a straightening operation;

FIG. 4 is an elevation view of an initially cut metal billet;

FIG. 5 is an elevation view of a squared billet;

FIG. 6 is a schematic representation of the squared billet being positioned in predetermined location prior to the cold forming process;

FIG. 7 is a schematic representation of the impact loading and forming process through the impacting of the squared metal billet by a second male die and the extrusion around a first male die partially inserted within the internal cavity of the female die:

FIG. 8 is a schematic representation showing the socket clamped within the female die and the first male die being longitudinally displaced to form a through opening for the socket;

FIG. 9 is a perspective view of a completed socket wrench;

FIG. 10 is an elevation view of a finished socket wrench;

FIG. 11 is a schematic representation of the finished socket wrench showing the metal flow during the cold forming operation; and, FIG. 12 is a schematic representation showing the insertion of a third male die to form ball detents within an inner wall of the socket wrench.

DESCRIPTION OF THE PREFERRED EMBODIMENTS

Referring now to FIGS. 1–9 there is shown an improved method or manufacturing process of forming cold formed and/or cold forged socket wrenches 8 devoid of any additional and further machining operations. The improved process as will be described in the following paragraphs provides for the manufacture of sockets including socket adapters, universal attachments, universal joints, extension bars, nut runners, ratchet housings, spark plug sockets and other deep well sockets. The improved method of manufacture minimizes labor costs by reducing handlings of socket wrench 8 to be processed and provides a scrapless method of producing such items, and reduces overall operation costs by eliminating numerous machine operations. Additionally, increased strength of the finished product has been found due to the continuous flow of material during the cold forming operation. Further, it has been found that the improved manufacture process has optimized the use of the material by providing a socket 8 which is devoid of fins and/or flash created on the finished product which in other methods of manufacture would have to be removed. In general, the socket wrenches 8 as manufactured in this improved method are completely finished and ready for heat treatment, vibratory cleaning and final decorative plating.

Initially, steel is received in coil form as is schematically shown in FIG. 1. Generally, at the steel mill, coil steel 10 is finished to provide a coil having no seams, or other surface defects which may have an adverse affect on the cold forming process. After the finish is inspected for flaws, coil steel 10 passes through a final spherodized annealing.

The composition of the coiled steel 10 is of importance due to the extreme stresses applied to the working metal that the improved method of cold forming dictates. In general, coil steel 10 may be classified as a boron steel with a high manganese content. Boron is added in order to allow the steel to flow when severe deformation occurs in high speed operation such as the cold forming steps as will be detailed in following paragraphs. Thus, the boron prevents cracking or other stress failures which would render the final socket wrenches unusable. In order to achieve a final product which has a high hardness, the manganese content of the steel is increased over and above normal ranges. Generally, manganese steel used in prior methods includes a manganese content of between 0.60% to 0.80% by weight which did not permit a Rockwell hardness above approximately 28. By increasing the manganese content into the range between 0.80% to 1.10% it has been found that the hardness range of the final product is seen to be between 39.0 and 47.0 Rockwells. Thus, this modification of the composition of the coil steel 10 permits the cold forming method steps to be achieved and allows continuous flow of the metal while maintaining a high hardness after heat treating and producing a high grade mechanic's hard tool of the final socket product. After experimentation, it has been found that the weight composition range for a useful coil steel 10 which can flow under the extreme stresses of the cold forming process while providing a high hardness finished product is:

Sulphur: 0.050%
Phosphorous: 0.040% max.
Boron: 0.0005% min.
Manganese: 0.80%–1.10%
Carbon: 0.18–0.23%
Iron: Balance As is shown in FIG. 2 coil steel 10 is next treated with a lubricant to provide a coating which adheres to the steel surface and allows the steel to flow in a non-restricting manner as well as to diminish the possibility of seizing of the metal in a high speed operation. Coated steel 12 is provided either with a hot phosphate coating or surface treated with an agent which is commercially available and has the trade name Bonderizing.

Thus, once the mill finished steel is provided in coil form 10, a lubricant is applied to provide coated steel coil 12. The important consideration being that coated steel coil 12 includes the appropriate chemical composition analysis with the added alloys in the steel as has hereinbefore been described in order to permit cold forming and metal flow in an optimized manner and to provide a strong, complete and continuous durable forged part without fracture or other stress deformations in the severe cold forming operations that follow as will be described in following paragraphs.

As shown in FIG. 3, coil steel 12 is then passed through straightening dies or rollers 14 in order to provide a substantially linearly contoured stock of material. Such straightening dies or rollers 14 are well known in the art and may be incorporated within a cold forming machine or such may be provided as a separate entity not important to the inventive concept as is herein described.

The next consecutive step in the cold forming of the forged socket wrench 8 of the instant invention is shown in FIG. 4 where straightened coated steel coil 12 is cut to initially formed billet 16 of predetermined length. The important consideration being that the volume of billet 16 is substantially equal to the final solid volume of socket 8 shown in FIG. 9. The cutting operation is performed through one of a number of techniques such as utilization of a shearing tool or some like cutting mechanism not important to the invention. In general, the cutting operation provides opposing surfaces 18 and 20 which are generally not parallel each to the other. The important consideration in this stage of the operation being that the internal volume of initially cut billet 16 is substantially equal to the final solid volume of finished socket 8.

One of the unexpected results of this method invention is the fact that it has been found that initially cut billet member 16 as shown in FIG. 4 is not adaptable to the subsequent cold forming steps. The non-parallel opposing surfaces 18 and 20 have been found to cause undue stresses in the dies which are used in subsequent steps. Where non-parallel surfaces 18 and 20 are utilized in the cold forming process steps, it has been found that the male dies are provided with unacceptable stresses in directions normal to longitudinal direction 40 shown in FIG. 6. These stresses tend to cause displacement of the male dies in a direction generally transverse to longitudinal direction 40 and has the effect of producing unwanted bending moments which consequently causes excessive breakage of the dies.

Additionally, it has been found that where non-parallel surfaces 18 and 20 are utilized in a billet 16 during the cold forming process, such has the effect of providing an increased amount of cold working during the forming process and has a resulting effect of unduly hardening billet 16 leading to a difficult forming process. Thus, additional forces must be applied to billets 16 which may result in a low quality socket 8.

In order to alleviate this problem it has been found necessary for initially cut billet 16 to be squared to provide parallel opposing surfaces 18' and 20' as is shown in FIG. 5. Initially cut billet 16 is inserted into a standard first and second formed cavity mold which may be formed of a carbide material. Initially cut billet 16 is then compressively stressed and displaced in longitudinal direction 40 until opposing surfaces 18' and 20' lie in parallel planes substantially normal to longitudinal direction 40.

Thus, as has been described, initially cut billet 16 is sheared or otherwise fractured as is shown in FIG. 4 to provide surfaces which are generally not parallel each to the other. Subsequently squared billet 22 is formed as shown in FIG. 5 having opposing faces or surfaces 18' and 20' in longitudinally displaced opposing parallel planes which permit insertion of male dies during the cold forming process in a manner to essentially provide displacement of the male dies solely in a direction normal to the planes of opposing surfaces 18' and 20'. Thus, squared metal billet 22 is established as shown in FIG. 5 which has a predetermined volume. The predetermined volume although varying for different sizes of sockets 8 to be manufactured in the improved cold forming process as is herein described is important in that in any cold forming operation, the initial volume of the metal within squared billet 22 must substantially equal the final formed solid volume of socket 8 being manufactured.

FIGS. 6–8 generally show the steps in the cold forming of squared billet 22. Female dies 24 having internal cavity 44 with internal taper surface 42 is provided to receive squared billet 22. Internal cavity 44 is formed by aligned passages 60 and 62 defining a longitudinally directed through opening for female die 24. Solid male dies or first male die 32 is maintained in generally fixed position or location partially within internal cavity 44 within passage 62 as is seen in FIGS. 6 and 7. First male die 32 has a cross-sectional area less than the smallest area of passage 62 in order that die 32 may be inserted and removed from passage 62.

Squared billet 22 is inserted within passage 60 of internal cavity 44 and upon the conclusion of the cold forming process steps forms taper section 26 on at least a portion of the external surface of billet 22. Thus, die member 24 is generally positioned in a surrounding manner to first end or or adaptor end 28 of billet 22 in order that displacement of billet 22 against an internal surface of female die 24 will cause deformation and flow of material responsive to longitudinal movement of a second male die 30.

After insertion of squared billet 22 within internal cavity 44 of female die 24, second male die 30 is directionally displaced in longitudinal direction 46 as is shown in FIG. 7. Second male die longitudinally impacts second end 34 of squared metal billet 22 to form first recess 64 shown in FIGS. 7 and 8. Compressive displacement of billet 22 causes cold forming flow of metal of billet 22 against the internal surfaces of female die as well as being extruded around male die 32 to form second socket recess 66 as is seen in FIG. 7 and 8. Male die 30 is moved or displaced into close proximity to section line 48 generally defining the boundary line between the adaptor end 28 and the second end 34 of completed cold formed socket 8 as well as the boundary plane between passages 60 and 62 of female die 24.

Referring now to FIG. 8, male die 32 may then be longitudinally moved in direction 50 to provide for a continuous through opening for socket 8. First male die 32 is displaced longitudinally into first socket recess 64 resulting in the socket through opening. To insure that partially formed socket 8 is not displaced external to female die 25, annular ring 52 is positionally placed contiguous and adjacent to frontal wall 54 as is shown subsequent to the removal of second male die 30 from passage 60 of cavity 44. Thus, in this manner, a through opening may be formed for socket 8.

In order to eject socket from internal cavity 44, annular ring 52 is first removed from contact with frontal wall 54. Solid male die 32 includes sleeve member 56 which has a diameter slightly less than opening 58 of internal cavity 44. By continued displacement of first male die 32 in direction 50, sleeve member 56 may be moved adjacent to first end 28 of formed socket 8 within female die 24 and through a further movement of male die 32 in direction 50, formed socket may be ejected from female die 24.

Ball detents 38 may also be formed as shown in FIG. 12. Where detents 38 are to be formed, the process steps following the operation shown in FIG. 8, include the removal of annular ring 52 from frontal wall 54 as well as the removal of first male die 32 from internal cavity 44. Third male die 68 having longitudinally extending appendages 40 is moveably displaced in direction 46. Appendages 40 extend radially from die extension member 82 to intersect an inner wall of passage 66. A shoulder may be formed by die section 70, however, such is not important to the inventive concept as is herein described. Main body 72 of male die 68 has a diameter substantially equal to but slightly less than the diameter of passage 64. Additionally, die 68 may include taper forming section 74 to provide an internal taper 76, shown in FIG. 11.

Ball detents 38 are formed on certain sized sockets due to their weight in order that a ratchet device may firmly hold the completed socket to maintain it in a predetermined fixed position and restrain such from falling or otherwise removing itself from the ratchet device.

What is claimed is:

1. A method of forming forged socket wrenches devoid of machining operations including the steps of:

a. establishing solid metal billet having a predetermined volume, said billet having an extended dimension in a longitudinal direction;

b. squaring opposing longitudinal ends of said billet to form a pair of opposing substantially parallel planar faces being substantially normal to said longitudinal direction;

c. inserting said squared billet within an internal cavity of a female die having a through opening and adapted to form a taper on at least a portion of an external surface of said metal billet;

d. locating a first solid male die partially within said internal cavity tapered portion, said first male die having a cross-sectional area less than said female die through opening cross-sectional area; and, e. longitudinally impacting a second end of said metal billet with a second male die to form a first socket recess, said billet being extruded around said first male die to form a second socket recess.

2. The method as recited in claim 1 where the step of longitudinally impacting is followed by the step of removing said second male die from said internal cavity of said female die.

3. The method as recited in claim 2 where the step of removing is followed by the step of clamping said billet within said female die.

4. The method as recited in claim 3 where the step of clamping is followed by the step of displacing said first male die longitudinally into said first socket recess thereby forming a socket through opening.

5. The method as recited in claim 4 where the step of displacing said first male die is followed by the step of removing said first male die from said internal cavity of said female die.

6. The method as recited in claim 5 where the step of removing said first male die is followed by the step of removing said clamp from said female die.

7. The method as recited in claim 6 where the step of removing is followed by the step of inserting a third male die having longitudinally extending appendages into said second socket recess to form at least one longitudinal channel within an inner wall of said socket to provide a detent adapted to receive a driving tool.

8. The method of forming forged socket wrenches as recited in claim 1 wherein said metal billet is composed of steel.

9. The method of forming forged socket wrenches as recited in claim 8 wherein said steel billet includes a predetermined manganese content of between 0.80%-1.1% of said weight of said billet.

10. The method of forming forged socket wrenches as recited in claim 9 where said steel billet includes a predetermined boron content of approximately 0.0005% of said weight billet.

* * * * *